US006554456B1

(12) United States Patent
Buelow, II et al.

(10) Patent No.: US 6,554,456 B1
(45) Date of Patent: Apr. 29, 2003

(54) EFFICIENT DIRECTIONAL LIGHTING SYSTEM

(75) Inventors: Roger F. Buelow, II, Cleveland Heights, OH (US); John M. Davenport, Lyndhurst, OH (US); Juris Sulcs, Chagrin Falls, OH (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 09/565,257

(22) Filed: May 5, 2000

(51) Int. Cl.[7] ..... F21V 7/00

(52) U.S. Cl. ..... 362/347; 362/551; 362/560; 362/556; 362/350; 362/343

(58) Field of Search ..... 362/347, 350, 362/560, 343, 308, 551, 282, 552, 556, 581, 580

(56) References Cited

U.S. PATENT DOCUMENTS 2,989,620 A * 6/1961 Green ..... 362/350
4,956,759 A * 9/1990 Goldenberg et al. ..... 362/297
5,245,515 A * 9/1993 Schwaller et al. ..... 362/308
5,271,077 A 12/1993 Brockman et al.
5,584,557 A * 12/1996 Alexay ..... 362/32
5,791,756 A 8/1998 Hulse et al.
5,812,713 A 9/1998 Allen et al.
6,304,693 B1 * 10/2001 Buelow, II et al. ..... 362/298

* cited by examiner

*Primary Examiner*—Sandra O'Shea
*Assistant Examiner*—Bertrand Zeade
(74) *Attorney, Agent, or Firm*—Charles E. Bruzga

(57) ABSTRACT

An efficient system for directing light comprises a light source and a generally tubular, hollow coupling device. The coupling device has an interior light-reflective surface for receiving light from the source at an inlet and transmitting it as a generally diverging light beam through an outlet. The device is shaped in accordance with non-imaging optics and increases in cross sectional area from inlet to outlet so as to reduce the angle of light reflected from the surface as it passes through the device. The foregoing system provides a discharge-based directional light source that can be of the size of a directional halogen source (e.g., an MR16 or MR 11 lamp) while substantially preserving the discharge efficiency, light-output capacity and lifetime of discharge-based sources. This results from the coupling device that provides light with good spatial uniformity in light intensity and color. Embodiments of the invention can simply split the light to multiple (e.g., two) destinations with substantially the same efficiency.

13 Claims, 5 Drawing Sheets

EFFICIENT DIRECTIONAL LIGHTING SYSTEM

CROSS-REFERENCE TO RELATED APPLICATIONS

This application is related to application Ser. No. 09/454,073, issued as U.S. Pat. No. 6,304,693, by the same inventors but owned by different assignees.

FIELD OF THE INVENTION

The present invention relates to an optical lighting system for efficiently collecting and directing light, for example, downwardly from a ceiling fixture.

BACKGROUND OF THE INVENTION

Halogen directional light sources (e.g., MR16 and MR11 lamps) have been used for localized lighting applications, such as task-, accent- and down-lighting. However, since these halogen sources use filaments, they characteristically have low light-delivery efficiency. For example, an EXT lamp, a 50-watt narrow-beam halogen source, typically delivers about 500 task lumens with an energy expenditure of about 55 watts (with an electronic converter) or 60 watts (with a transformer) for a delivered efficiency of about 8–9 lumens per watt. This is for the simplest optical system. In applications where considerable beam conditioning is required through the use of multiple lenses, for example, efficiencies can drop to 5 lumens per watt or less. In addition, because the filament evaporates over time, practical lifetimes are typically limited to 4000 hours or less. Further, thermal considerations limit the practical operating power limits of these sources to about 75 watts, and, therefore, the light output to about 700 lumens or less, for the applications discussed above. Often, larger light outputs would be desirable for each light point—e.g., for down-lighting applications.

In recent years, owing to the desirability of replacing the foregoing directional filament-type sources with more efficient gas discharge-based alternatives, a number of new directional lamps types have been developed. Unfortunately, owing to the added optical, size and color-averaging requirements of the discharge sources used, the use of conventional imaging optics has resulted in directional light sources that, while significantly more efficient and with lifetimes significantly longer, are also significantly larger than the directional halogen sources they seek to replace. The smallest directional discharge sources are packaged as PAR30 lamps, about 2 times the size of an MR16 lamp and 3 times the size of an MR11 lamp. It would, therefore, be desirable to provide a discharge-based directional light source that could be of the size of a directional halogen source (MR16 or MR 11) while preserving the discharge efficiency, light-output capacity and lifetime of discharge-based sources. It would also be desirable to be able to split the light output simply and with comparable efficiency where a second directional output is required. (For larger numbers of outputs, e.g. six, fiberoptic approaches may be preferable.)

SUMMARY OF THE INVENTION

An exemplary embodiment of the invention provides an efficient system for directing light, comprising a light source and a generally tubular, hollow coupling device. The coupling device has an interior light-reflective surface for receiving light from the source at an inlet and transmitting it as a generally diverging light beam through an outlet. The device is shaped in accordance with non-imaging optics and increases in cross sectional area from inlet to outlet so as to reduce the angle of light reflected from the surface as it passes through the device.

The foregoing system provides a discharge-based directional light source that can be of the size of a directional halogen source (e.g., an MR16 or MR 11 lamp) while substantially preserving the discharge efficiency, light-output capacity and lifetime of discharge-based sources. This results from the coupling device that provides light with good spatial uniformity in light intensity and color.

Embodiments of the invention can simply split the light to multiple (e.g., two) destinations with substantially the same efficiency.

DETAILED DESCRIPTION OF THE INVENTION

Figure 1:
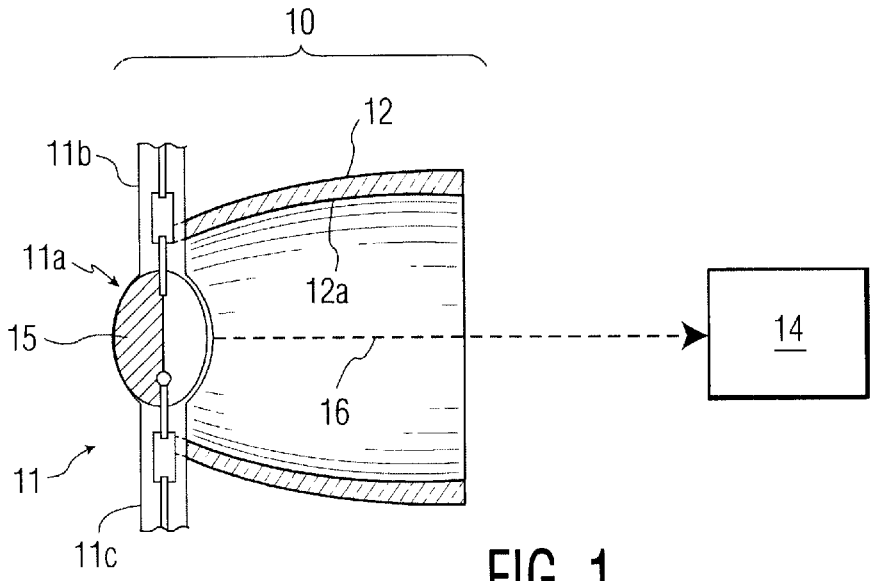
FIG. 1 is a side plan view of an lighting system partially in cross section and partially in block form, in accordance with the invention.
Figure 1A:
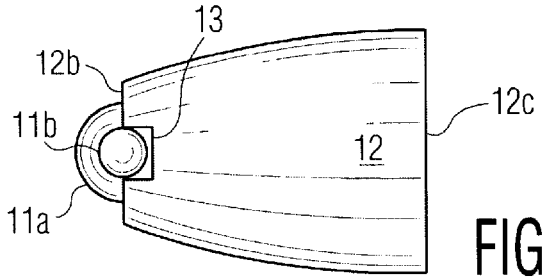
FIG. 1A is a top plan view of a lamp and coupling device of FIG. 1.

FIGS. 1 and 1A show a lighting system 10 according to the invention. The lighting system employs a lamp, or light source, 11 and a light coupling device 12 for illuminating a target area 14. Lamp 11 preferably is a metal halide lamp as shown, but may also be a filament-type halogen lamp, or an electrodeless lamp, by way of example. A reflective member 15, shown cross-hatched, directs light from the left-shown side of lamp 11 into coupling device 12. This allows for a high amount of light to be transmitted through the coupling device. Lamp 11 has an enlarged, or bulbous, region 11*a* and upper and lower arms 11*b* and 11*c*.

Coupling device 12 is generally tubular and has a respective, interior light-reflecting surface 12*a* for receiving light at an inlet end, nearest the lamp, and for transmitting it to an outlet end shown at the right. As best shown in FIG. 1A, most of the inlet end of the coupling device preferably extends half-way across the lamp, from right to left, with recess 13 receiving top arm 11*b* of the lamp aid another recess (not shown in FIG. 1A) receiving lower arm 11*c* of the lamp. In more detail, recess 13 extends from a first axially oriented edge 12*b* of device 12 to a second axially oriented edge 12*c* of the device and receives top arm 11*b* of the lamp, for positioning the lamp closer to the second edge 12*c*. This maximizes light extraction from the lamp.

The coupling device increases in cross-sectional area from inlet to outlet in such manner as to reduce the angle of light reflected from its interior surface as it passes through the device, while transmitting it as a generally diverging light beam through the outlet. By "generally diverging" is meant that a substantial number of light rays diverge from main axis 16, although some rays may be parallel to the axis. Preferably, substantially all cross-sectional segments of surface 12*a* orthogonal to a main axis 16 of light propagation substantially conform to a compound parabolic collector (CPC) shape. A CPC is a specific form of an angle-to-area converter, as described in detail in, for instance, W. T. Welford and R. Winston, High Collection Nonimaging Optics, New York: Academic Press, Inc. (1989), chapter 4 (pp. 53–76).

Lighting system 10 typically illuminates target area 14 with light having high spatial uniformity in both light intensity and color distribution. This is because coupling device 12 conditions the light much more effectively than prior art reflectors (not shown) of the elliptical or parabolic type, for example. Typically, system 10 can provide substantially all of the light to target area 14 within a predetermined angle, for example, 35 degrees from main axis 16.

Traditionally, reflectors (not shown) control light from light sources in a so-called "imaging" method. Elliptical reflectors, for example, image the light source, positioned at a first focus of the reflector, onto a second focus. The controlled light converges from the surface of the reflector to the second focus as the light exits the reflector. Parabolic reflectors are another example of optics using imaging. In a parabolic reflector, the controlled light is collimated so that light rays exit in a generally parallel fashion. In contrast, the coupler of the present invention uses "non-imaging" optics, and, in preferred embodiments, realizes small size and superior light-mixing properties possible with such optics. As the light leaves a non-imaging collector (e.g., coupling device 12), most of the light is controlled so as to be generally diverging at a directionally useful angle (for example, up to 35 degrees) as it leaves the reflector. This is an important aspect of a lighting system since the light is most highly concentrated at the exit of the non-imaging collector (e.g., coupling device 12). In contrast, in an elliptical system the light is most highly concentrated at the second focus. For a parabolic system, the light concentration is practically the same wherever it is collected. Although the light emitted by a parabolic system may have a high angular uniformity, its imaging quality typically precludes high spatial uniformity in light intensity (and color as well for discharge sources).

Figure 2:
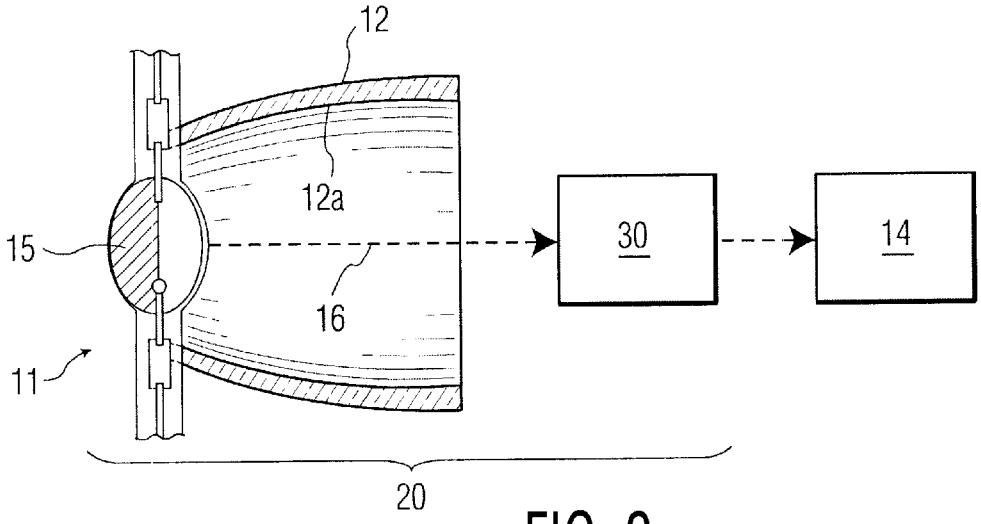
FIG. 2 is a side plan view of another lighting system partially in cross section and partially in block form, in accordance with the invention.
Figure 3:
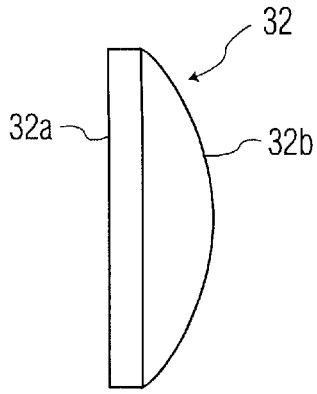
FIG. 3 is a side plan view of an optical lens.

FIG. 2 shows a lighting system 20 that is similar to lighting system 10 (FIG. 1) but which includes conditioning optics 30 between coupling device 12 and target area 14. Due to the typically high spatial uniformity in light intensity and color, the conditioning optics can often comprise a single lens, e.g., plano-convex lens 32 of FIG. 3 having a planar surface 32*a* through which light rays (not shown) may be received and a convex surface 32*b* through which light rays may exit. Lens 32 will typically reduce their angular distribution. Other types of lenses, such as Fresnel lenses, can be used as will be obvious to those of ordinary skill in the art based on this specification.

Figure 4:
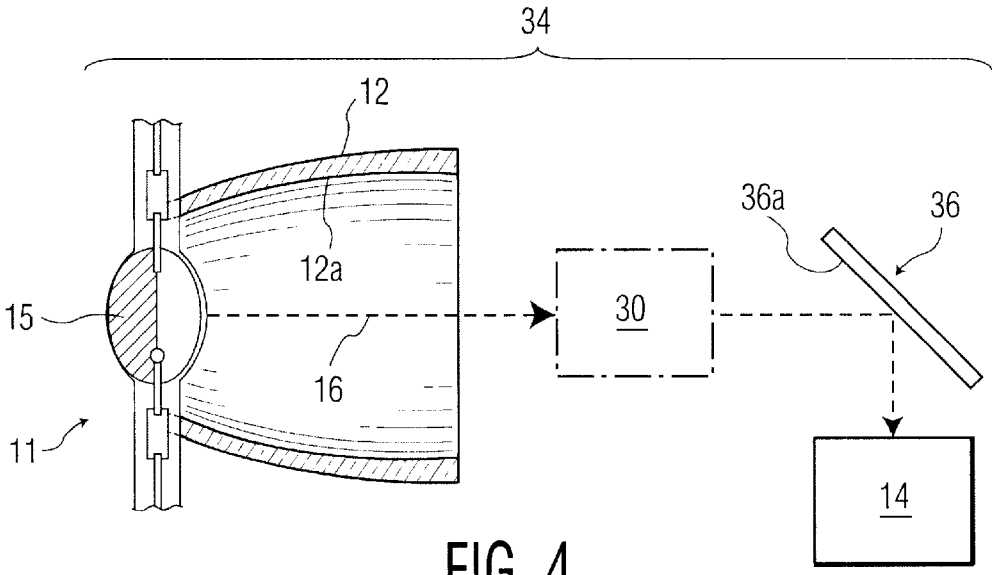
FIG. 4 is a side plan view of yet another lighting system partially in cross section and partially in block form, in accordance with the invention.

FIG. 4 shows a light distribution system 34 that is similar to lighting system 20 (FIG. 2) but which includes a moveable mirror 36 with a reflective surface 36*a* for redirecting light from conditioning optics 30. Collection optics 30 are shown by a phantom-line box to indicate that it may be omitted if desired.

Figure 5:
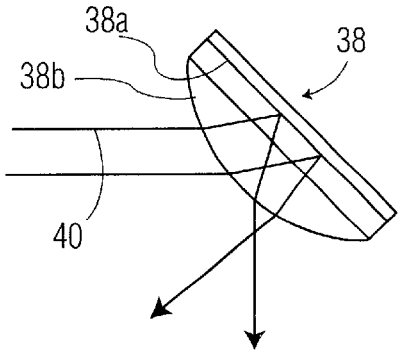
FIG. 5 is a side plan view of a mirror integrally formed on a lens for conditioning and redirecting light rays.
Figure 6:
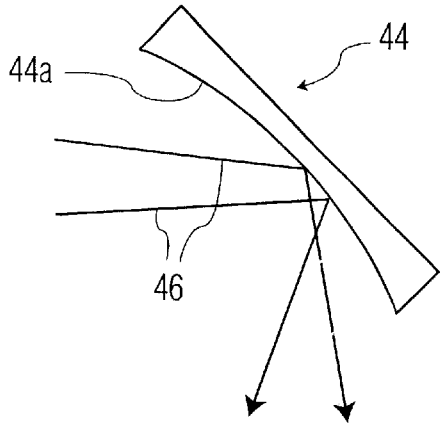
FIG. 6 is a side plan view of a curved mirror for conditioning and redirecting light rays.

The function of a conditioning optics and mirror may be integrated into a single unit, such as unit 38 of FIG. 5. Unit 38 has a planar reflective surface 38*a* and a plano-convex lens 38*b*. Light rays 40 travels along paths as shown. An alternative unit 44, shown in FIG. 6, integrates both functions as well. Unit 44 comprises a mirror with a curved, concave reflective surface 44*a*, for directing light ray 46*s* in the paths shown.

Figure 7:
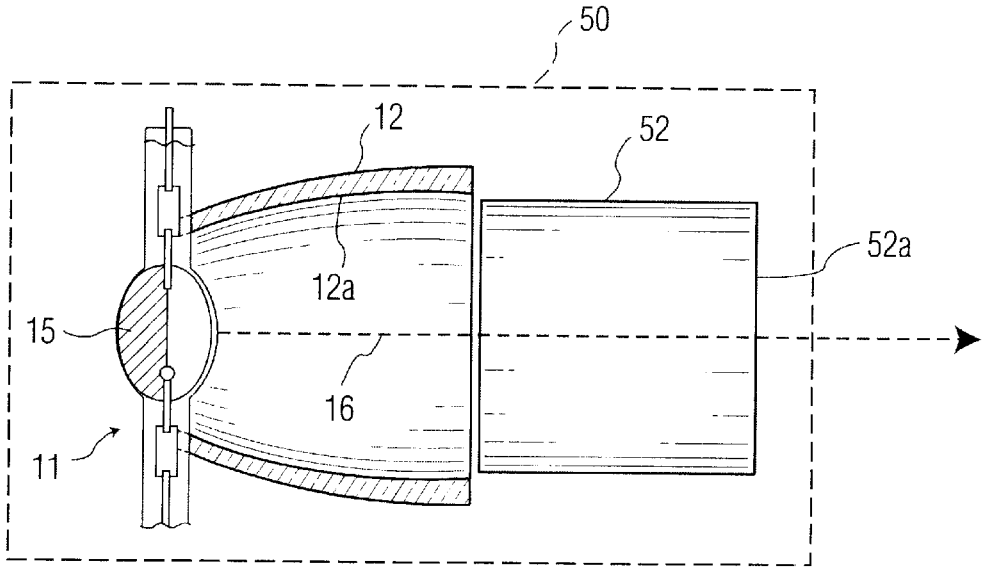
FIG. 7 is a side plan view of another lighting system partially in cross section, in accordance with the invention.
Figure 8:
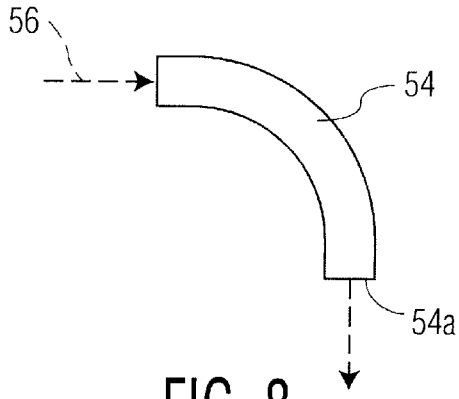
FIGS. 8 is a side plan view of an edge-defining member that may be used in the lighting system of FIG. 7.

FIG. 7 shows a lighting system 50 including lamp 11 and coupling device 12 as in FIG. 1. It also includes an edge-defining member 52 for receiving a light beam from the coupling device and transmitting it through an outlet 52*a* with its peripheral edge more sharply defined. Member 52 can be a tubular quartz rod, by way of example, that can have one or more of IR, UV or AR coatings on either of both of its inlet (left-shown) surface and its outlet surface 52*a*. System 50 can replace lamp 11 and coupling device 12 in FIGS. 1, 2, 4 or 7. For instance, when replacing lamp 11 and coupling device 12 of FIG. 1, light rays are transmitted from outlet 52*a* directly to target area 14 (FIG. 1) without the use of intermediate conditioning optics, such as 30 in FIG. 2. If redirection of the light is desired, an edge-defining member 54 with a bend, e.g., as shown in FIG. 8, can be used instead of member 52. Thus, a light ray 56 received in the left-shown inlet of member 53 (FIG. 8) exits downwardly through outlet 54*a*.

Figure 9A:
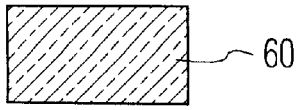
FIGS. 9A–9E are cross sections of an edge-defining member of FIG. 7 or FIG. 8.
Figure 9B:
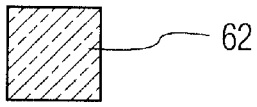
Figure 9C:
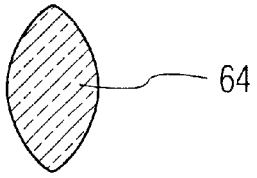
Figure 9D:
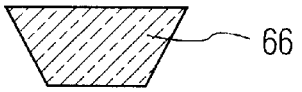
Figure 9E:
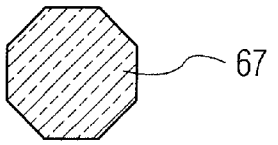

FIGS. 9A–9E show preferred cross sections of edge-defining member 52 (FIG. 7) or 54 (FIG. 8) along a main direction (not shown) of light propagation. FIG. 9A shows a rectangular cross section 60; FIG. 9B, a square cross section 62; FIG. 9C, an oval cross section 64; FIG. 9D, a trapezoidal cross section 66; and FIG. 9E, a hexagonal cross section 67. Other shapes, e.g., pentagonal, can be used as will be apparent to those of ordinary skill in the art. It is known that some degree of spatial uniformity in light intensity and color results from using an edge-defining member in a conventional lighting system (not shown) using reflectors and, hence, imaging optics. However, for a square cross section, as in FIG. 9B, the length-to-width ratio of such member in a conventional system is typically about 8:1 to achieve good uniformity. The same degree of uniformity can be achieved (e.g. FIG. 1) with a much lower ratio in the present invention using non-imaging optics, e.g., about 2:1 to 3:1.

Figure 10:
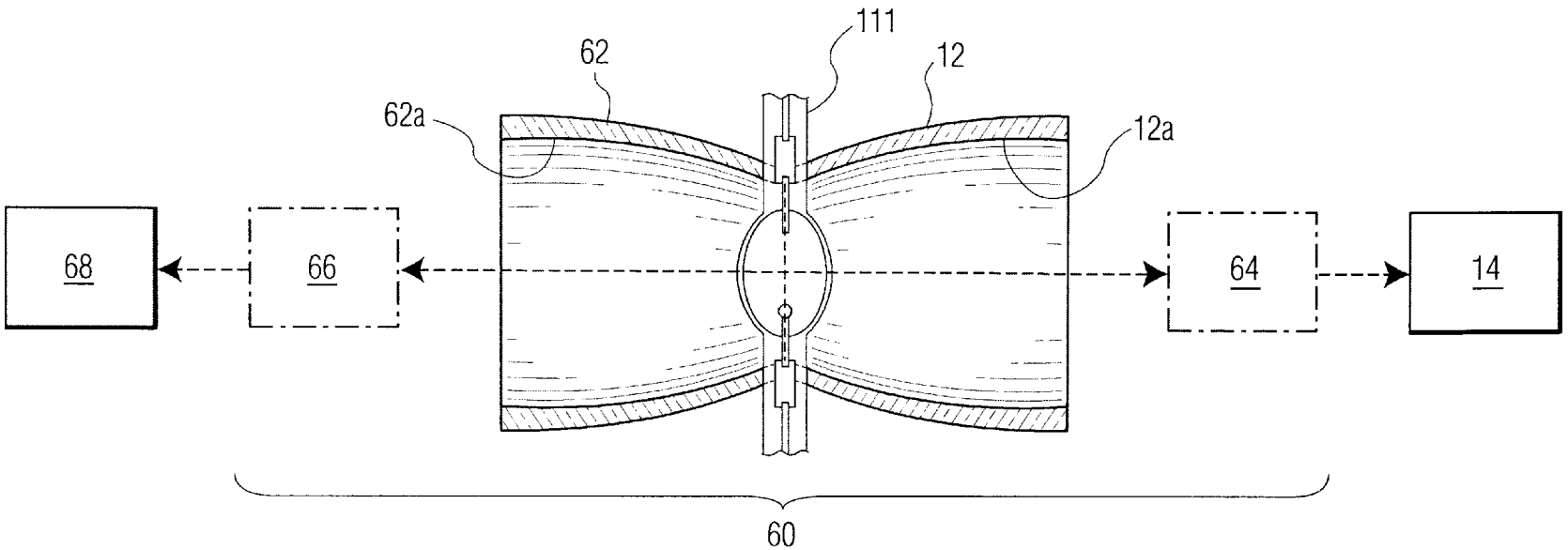
FIG. 10 is a side plan view of still another lighting system partially in cross section, in accordance with the invention.

FIG. 10 shows a coupling system 60 using lamp 111 and coupling device 12, as in FIG. 1, and a second coupling device 62 preferably with the same construction as device 12. Light passing through device 12 may optionally be conditioned, redirected, or both by optional optics 64 (shown in phantom) before reaching target area 14. With lamp 111 omitting the reflective coating 15 of lamp 11 (FIG. 1), light passes also through coupling device 62 with interior light-reflecting surface 62*a*, and optionally may be conditioned, redirected, or both by optics 66 (shown in phantom) before reaching target area 68. Optics 64 and 66 perform one or more optical functions as described above, for instance, with respect to lens 32 of FIG. 3, or mirror 36 of FIG. 4. More than two coupling devices can be used if desired, but for six outputs, for instance, fiberoptic approaches may be preferable.

While the invention has been described with respect to specific embodiments by way of illustration, many modifications and changes will occur to those of ordinary skill in the art. For instance, with reference to FIG. 7, the function of conditioning optics 30 (FIG. 2) may be realized partially or entirely by forming edge-defining member 52 with an increasing cross section from left to right. Alternatively, with reference to FIG. 2, such function may be partially or fully realized by extending coupling device 12 to the right with increasing cross section. It is, therefore, to be understood that the appended claims are intended to cover all such modifications and changes as fall within the true scope and spirit of the invention.

What is claimed is:

1. An efficient system for directing light, comprising:

a) a light source having a bulbous region and a first member projecting from the bulbous region;

b) a generally tubular, hollow coupling device with an interior light-reflective surface for receiving light from the source at an inlet and transmitting it as a generally diverging light beam through an outlet; the coupling device being shaped in accordance with non-imaging optics and increasing in cross sectional area from inlet to outlet so as to reduce the angle of light reflected from the surface as it passes through the device;

c) the inlet and the outlet of the device being respectively defined by first and second axially oriented edges, the first edge having a recess extending in the direction of the second edge and receiving the first member, for positioning the light source closer to the second edge; and d) conditioning optics comprising at least one lens for receiving the light beam after it passes through the coupling device and giving it a desired pattern.

2. The system of claim 1, wherein the conditioning optics comprises only one lens.

3. The system of claim 1, further comprising a moveable mirror for receiving light from the conditioning optics and redirecting it.

4. The system of claim 3, wherein the mirror is integrally formed with the one lens.

5. An efficient system for directing light, comprising:

a) a light source having a bulbous region and a first member projecting from the bulbous region;

b) a generally tubular, hollow coupling device with an interior light-reflective surface for receiving light from the source at an inlet and transmitting it as a generally diverging light beam through an outlet; the coupling device being shaped in accordance with non-imaging optics and increasing in cross sectional area from inlet to outlet so as to reduce the angle of light reflected from the surface as it passes through the device;

c) the inlet and the outlet of the device being respectively defined by first and second axially oriented edges, the first edge having a recess extending in the direction of the second edge and receiving the first member, for positioning the light source closer to the second edge; and d) substantially all cross sectional segments of the light-reflective surface orthogonal to a main axis of light propagation substantially conforming to a compound parabolic collector shape; and e) a moveable mirror for receiving light from the coupling device and redirecting it without passing through an intermediate lens.

6. The system of claim 5, wherein the mirror is curved so as to also condition light by giving it a desired pattern.

7. An efficient system for directing light, comprising:

a) a light source having a bulbous region and a first member projecting from the bulbous region;

b) a generally tubular, hollow coupling device with an interior light-reflective surface for receiving light from the source at an inlet and transmitting it through an outlet; the coupling device being shaped in accordance with non-imaging optics and increasing in cross sectional area from inlet to outlet so as to reduce the angle of light reflected from the surface as it passes through the device;

c) an edge-defining member for receiving a light from the coupling device and transmitting it with its peripheral edge more sharply defined; the edge-defining member having an inlet positioned in proximity to an outlet of the coupling device and a cross section orthogonal to a main direction of light propagation; and d) the inlet and the outlet of the device being respectively defined by first and second axially oriented edges, the first edge having a recess extending in the direction of the second edge and receiving the first member, for positioning the light source closer to the second edge; and e) conditioning optics comprising at least one lens for receiving the light beam after it passes through the coupling device and giving it a desired pattern.

8. The system of claim 7, further comprising a moveable mirror for receiving light from the conditioning optics and redirecting it.

9. The system of claim 8, wherein the mirror is integrally formed with the one lens.

10. An efficient system for directing light, comprising:

a) a light source having a bulbous region and a first member projecting from the bulbous region;

b) a generally tubular, hollow coupling device with an interior light-reflective surface for receiving light from the source at an inlet and transmitting it through an outlet; the coupling device being shaped in accordance with non-imaging optics and increasing in cross sectional area from inlet to outlet so as to reduce the angle of light reflected from the surface as it passes through the device; and c) an edge-defining member for receiving a light from the coupling device and transmitting it with its peripheral edge more sharply defined; the edge-defining member having an inlet positioned in proximity to an outlet of the coupling device and a cross section orthogonal to a main direction of light propagation;

d) the inlet and the outlet of the device being respectively defined by first and second axially oriented edges, the first edge having a recess extending in the direction of the second edge and receiving the first member, for positioning the light source closer to the second edge; and e) the cross section being square.

11. An efficient system for directing light, comprising:

a) a light source having a bulbous region and a first member projecting from the bulbous region;

b) a generally tubular, hollow coupling device with an interior light-reflective surface for receiving light from the source at an inlet and transmitting it through an outlet; the coupling device being shaped in accordance with non-imaging optics and increasing in cross sectional area from inlet to outlet so as to reduce the angle of light reflected from the surface as it passes through the device; and c) an edge-defining member for receiving a light from the coupling device and transmitting it with its peripheral edge more sharply defined; the edge-defining member having an inlet positioned in proximity to an outlet of the coupling device and a cross section orthogonal to a main direction of light propagation;

d) the inlet and the outlet of the device being respectively defined by first and second axially oriented edges, the first edge having a recess extending in the direction of the second edge and receiving the first member, for positioning the light source closer to the second edge; and e) the cross section being oval.

12. An efficient system for directing light, comprising:

a) a light source having a bulbous region and a first member projecting from the bulbous region;

b) a generally tubular, hollow coupling device with an interior light-reflective surface for receiving light from the source at an inlet and transmitting it through an outlet; the coupling device being shaped in accordance with non-imaging optics and increasing in cross sectional area from inlet to outlet so as to reduce the angle of light reflected from the surface as it passes through the device; and c) an edge-defining member for receiving a light from the coupling device and transmitting it with its peripheral edge more sharply defined; the edge-defining member having an inlet positioned in proximity to an outlet of the coupling device and a cross section orthogonal to a main direction of light propagation;

d) the inlet and the outlet of the device being respectively defined by first and second axially oriented edges, the first edge having a recess extending in the direction of the second edge and receiving the first member, for positioning the light source closer to the second edge; and e) the edge-defining member comprises a three-dimensional solid that is light transmissive.

13. An efficient system for directing light, comprising:

a) a light source having a bulbous region and a first member projecting from the bulbous region;

b) a generally tubular, hollow coupling device with an interior light-reflective surface for receiving light from the source at an inlet and transmitting it through an outlet; the coupling device being shaped in accordance with non-imaging optics and increasing in cross sectional area from inlet to outlet so as to reduce the angle of light reflected from the surface as it passes through the device; and c) an edge-defining member for receiving a light from the coupling device and transmitting it with its peripheral edge more sharply defined; the edge-defining member having an inlet positioned in proximity to an outlet of the coupling device and a cross section orthogonal to a main direction of light propagation;

d) the inlet and the outlet of the device being respectively defined by first and second axially oriented edges, the first edge having a recess extending in the direction of the second edge and receiving the first member, for positioning the light source closer to the second edge; and e) the edge-defining member being so configured as to transmit light with angles suitably low for conditioning by a plano-convex lens.

* * * * *